US005719583A

United States Patent [19]

Kanai

[11] Patent Number: 5,719,583

[45] Date of Patent: Feb. 17, 1998

[54] MOBILE COMMUNICATION SYSTEM WHICH PERFORMS ANTENNA GAIN CONTROL

[75] Inventor: Toshihito Kanai, Tokyo, Japan

[73] Assignee: NEC Corporation, Tokyo, Japan

[21] Appl. No.: 748,492

[22] Filed: Nov. 8, 1996

[30] Foreign Application Priority Data

Nov. 13, 1995 [JP] Japan ..... 7-294206

[51] Int. Cl.[6] ..... H01Q 3/22

[52] U.S. Cl. ..... 342/378; 342/372

[58] Field of Search ..... 342/92, 372, 378, 342/382

[56] References Cited

U.S. PATENT DOCUMENTS

| | | | |
|---|---|---|---|
| 4,176,356 | 11/1979 | Foster et al. | 343/100 |
| 4,280,128 | 7/1981 | Masak | 343/100 LE |
| 4,286,268 | 8/1981 | Daniel et al. | 343/100 LE |
| 4,334,230 | 6/1982 | Kane | 343/797 |
| 5,305,373 | 4/1994 | Mizumoto | 375/61 |
| 5,327,143 | 7/1994 | Goetz et al. | 342/382 |

FOREIGN PATENT DOCUMENTS

| | | |
|---|---|---|
| 0713262 | 5/1996 | European Pat. Off. . |
| 59-152739 | 8/1984 | Japan . |
| 5-327612 | 12/1993 | Japan . |
| 2088173 | 6/1982 | United Kingdom . |

OTHER PUBLICATIONS

F. Haber et al., "Spatial Spectrum Estimation in a Coherent Signal Environment Using an Array in Motion", *IEEE Transactions on Antennas and Propagation*, vol. AP-34, No. 3, Mar. 1986, pp. 301-310.

L. C. Godara et al., "Analysis of Constrained LMS Algorithm with Application to Adaptive Beamforming Using Perturbation Sequences", *IEEE Trans on Antennas and Propagation*, vol. AP-34, No. 3, Mar. 1986, pp. 368-379.

K. Takao et al., "Tamed Adaptive Antenna Array", *IEEE Transactions on Antennas and Propagation*, vol. AP-34, No. 3, Mar. 1986, pp. 388-394.

*Primary Examiner*—Thomas H. Tarcza
*Assistant Examiner*—Dao L. Phan
*Attorney, Agent, or Firm*—Sughrue, Mion, Zinn, Macpeak & Seas, PLLC

[57] ABSTRACT

A mobile communication system includes an antenna, a first radio transmission/reception unit, a propagation loss calculating section, an antenna gain calculating section, an antenna gain selecting section, and a first weight control circuit. The antenna has a variable directivity pattern. The first radio transmission/reception unit transmits/receives communication information to/from a distant station through a communication channel by using the antenna. The propagation loss calculating section calculates a propagation loss in a radio channel including a communication channel between the antenna and the distant station. The antenna gain calculating section calculates a minimum antenna gain value required for communication under the condition of the propagation loss calculated by the propagation loss calculating section. The antenna gain selecting section selects an antenna gain not less than the minimum antenna gain value calculated by the antenna gain calculating section. The first weight control circuit controls the directivity pattern of the antenna in a communication state on the basis of the antenna gain selected by the antenna gain selecting section.

11 Claims, 5 Drawing Sheets

MOBILE COMMUNICATION SYSTEM WHICH PERFORMS ANTENNA GAIN CONTROL

BACKGROUND OF THE INVENTION

The present invention relates to an antenna gain control apparatus for a mobile communication system and, more particularly, to an antenna gain control apparatus for a mobile communication system using antennas each having a variable directivity pattern.

In a mobile communication system such as an automobile telephone system, base stations are distributed in a plurality of radio zones to provide communication services for mobile stations distributed in a wide range. Such a system is called a cellular system. According to the cellular system, as the maximum communication distance allowed between a base station and a mobile station increases, a more economical mobile communication system can be formed because the number of base stations required to cover a predetermined area decreases.

The maximum communication distance between a base station and a mobile station depends on the radio unit transmission power, the antenna gain, and a radio transmission technique such as a modulation/demodulation scheme as well as the propagation characteristics. However, the transmission power of a radio unit should be limited in consideration of the maximum speech communication time allowed on the mobile station side, and especially the portable terminal side, and the influences of electromagnetic waves on the human body. The maximum communication distance can be increased by increasing the gain of the base station antenna instead of increasing the transmission power.

As a method of increasing the maximum communication distance, the method disclosed in Japanese Patent Laid-Open No. 5-327612 is available, although it is not applied to an automobile telephone system. According to this method, a master unit (corresponding to a base station in an automobile telephone system) or a subsidiary unit (corresponding to a mobile station in the automobile telephone system) in a cordless telephone system uses a high-directivity, high-gain antenna to make the maximum communication distance long.

In this method, the master or subsidiary unit in the cordless telephone system has both a non-directional antenna and a directional antenna. In a normal state, the non-directional antenna is used to perform communication between the master unit and the subsidiary unit. When the distance between the master unit and the subsidiary unit increases to disable connection through the non-directional antenna, switching from the non-directional antenna to the directional antenna is performed to use the directional antenna. With this operation, the maximum communication distance is increased to enable connection between the master unit and the subsidiary unit.

When the non-directional antenna is to be used for communication, the directivity (the direction of radio waves) of the antenna need not be considered. When, however, the directional antenna is to be used for communication, the directivity of the antenna must always be considered. Although the above reference explains no detailed method of controlling the directivity of the antenna, the antenna of the subsidiary unit (mobile station) can be manually directed to a distant unit. Alternatively, the directivity of the antenna of the subsidiary or master unit may be ensured by automatically controlling radio waves to propagate to the distant unit by a mechanical or electrical method.

The use of an adaptive array or the like, which is designed to electrically control the directivity of the antenna, is expected in the future because of the good follow-up characteristics and high reliability.

In such a conventional mobile communication system, when switching control is to be performed on non-directional/directional antennas, it is checked first whether communication can be performed by using the non-directional antenna. If it is determined that communication cannot be performed, the directional antenna is used to start communication. This operation demands much time to select an antenna, resulting in a long delay time before connection. In a range in which communication can be performed by using the non-directional antenna, the non-directional antenna is always used. For this reason, the non-directional antenna, which requires large transmission power, is used for even a mobile station located relatively near the base station. As a result, the transmission power is wasted.

When communication is performed by using the direction antenna, it is impossible to make the antenna track a mobile station which moves at a relatively high speed, and allow the directivity of the antenna to follow it. Once tracking fails, it is impossible to resume communication by detecting the position of the mobile station again and controlling the directivity of the antenna.

SUMMARY OF THE INVENTION

It is an object of the present invention to provide an antenna gain control apparatus for a mobile communication system, which can shorten the time required for connection between a base station and a mobile station, including the time for antenna switching.

It is another object of the present invention to provide an antenna gain control apparatus for a mobile communication system, which can efficiently perform communication by controlling the transmission power and the antenna gain.

In order to achieve the above objects, according to the present invention, there is provided a mobile communication system comprising an antenna having a variable directivity pattern, a first transmission/reception unit for transmitting/receiving communication information to/from a distant station through a communication channel by using the antenna, propagation loss calculating means for calculating a propagation loss in a radio channel including a communication channel between the antenna and the distant station, antenna gain calculating means for calculating a minimum antenna gain value required for communication under the condition of the propagation loss calculated by the propagation loss calculating means, antenna gain selecting means for selecting an antenna gain not less than the minimum antenna gain value calculated by the antenna gain calculating means, and first directivity pattern control means for controlling the directivity pattern of the antenna in a communication state on the basis of the antenna gain selected by the antenna gain selecting means.

DESCRIPTION OF THE PREFERRED EMBODIMENTS

The present invention will be described next with reference to the accompanying drawings.

Figure 1:
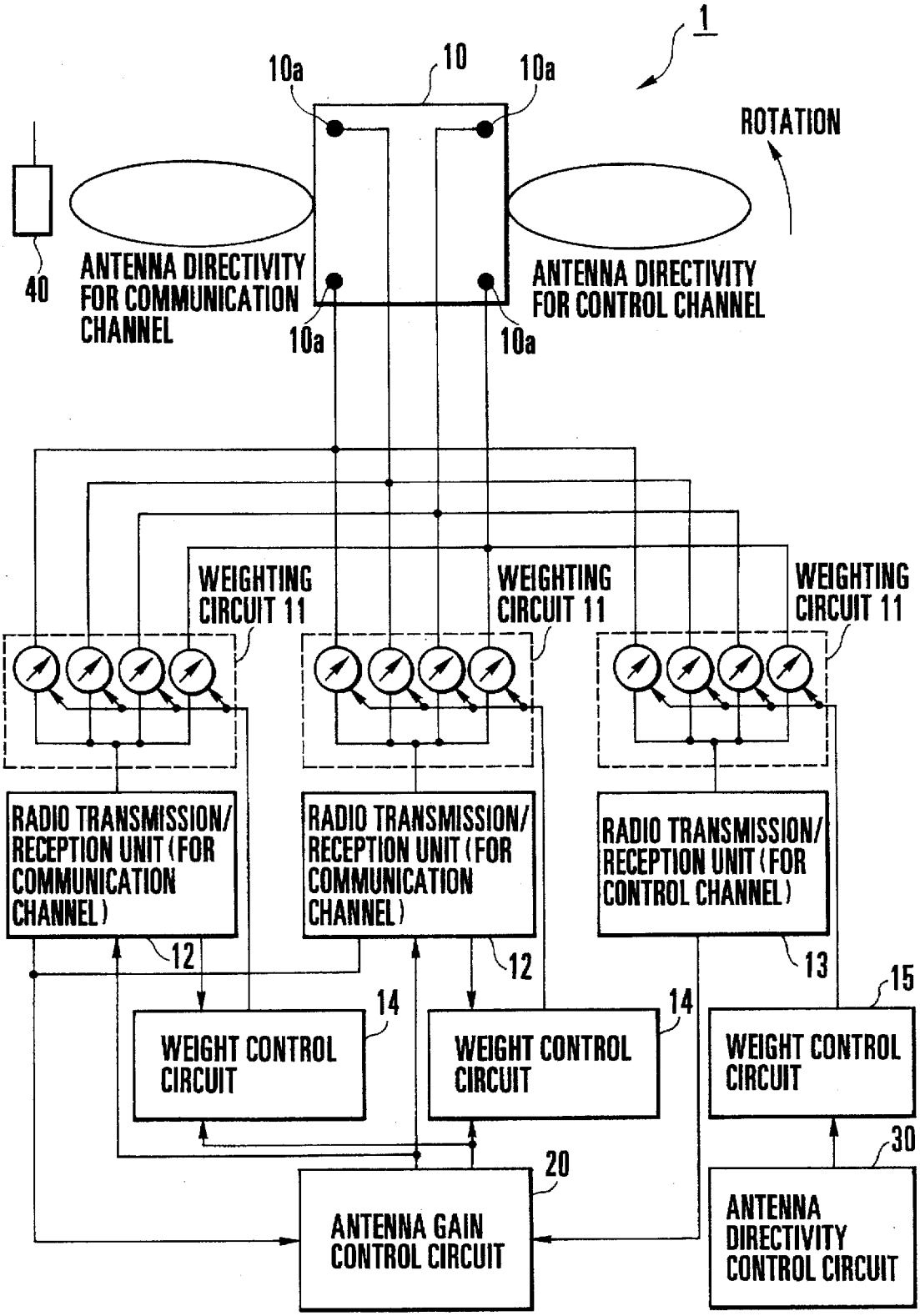
FIG. 1 is a block diagram showing a radio communication system according to an embodiment of the present invention.

FIG. 1 shows a base station in a radio communication system according to an embodiment of the present invention. In this case, the present invention is applied to a base station. However, the present invention can also be applied to a mobile station.

Referring to FIG. 1, reference numeral 1 denotes a base station; 10, an antenna constituted by four elements 10*a* and designed to perform radio communication between the base station 1 and a mobile station 40; 11, a weighting circuit for electrically setting the directivity of the antenna 10 for each communication channel and each control channel by weighting the elements 10*a* in accordance with weighting coefficients; 12, a communication channel radio transmission/reception unit (to be referred to as a first radio transmission/reception unit hereinafter); and 13, a control channel radio transmission/reception unit (to be referred to as a second radio transmission/reception unit hereinafter). The first radio transmission/reception unit 12 measures the self-station reception power and the self-station antenna gain in a communication channel during communication with the mobile station 40, and outputs the resultant data to an antenna gain control circuit (to be described later). The second radio transmission/reception unit 13 measures the self-station reception power and the self-station antenna gain in a control channel in a state of not communicating with the mobile station 40, and outputs the resultant data to an antenna gain control circuit (to be described later).

Reference numeral 14 denotes a communication channel weight control circuit (to be referred to as a first weight control circuit hereinafter) for calculating optimal weighting coefficients for maximizing the ratio of the desired wave, transmitted from the mobile station 40, to the interference wave (CIR: Carrier to Interference Ratio), and outputs the weighting coefficients to the weighting circuit 11; 20, an antenna gain control circuit for determining the antenna gain and the transmission power for a communication channel on the basis of outputs from the first and second radio transmission/reception units 12 and 13; 15, a weight control circuit (to be referred to as a second weight control circuit hereinafter) for calculating weighting coefficients such that the control channel directivity pattern rotates, and outputting the weighting coefficients to the weighting circuit 11; and 30, an antenna directivity control circuit for instructing the second weight control circuit 15 about the beam direction of a control channel.

In this case, the directivity pattern of the antenna 10 of the base station 1 is electrically rotated. As disclosed in Japanese Patent Laid-Open No. 59-152739, the directivity pattern may be mechanically rotated.

As a method used in the first weight control circuit 14 to obtain optimal weighting coefficients for maximizing the CIR for each mobile station 40, and a method used in the second weight control circuit 15 to obtain weighting coefficients for realizing an instructed beam direction, for example, the methods disclosed in the following articles are used: "Spatial Spectrum Estimation in a Coherent Signal Environment Using an Array in Motion", IEEE Trans. Antennas and Propagation, Special Issue on Adaptive Processing Antennas System, Vol. AP-34, No. 3, pp. 301–310, March 1986, "Analysis of Constrained LMS Algorithm with Application to Adaptive Beamforming Using Perturbation Sequences", IEEE Trans. Antennas and Propagation, Special Issue on Adaptive Processing Antennas System, Vol. AP-34, No. 3, pp. 368–379, March 1986, and "Tamed Adaptive Antenna Array", IEEE Trans. Antennas and Propagation, Special Issue on Adaptive Processing Antennas System, Vol. AP-34, No. 3, pp. 388–394, March 1986. A description of these methods will be omitted.

Figure 2:
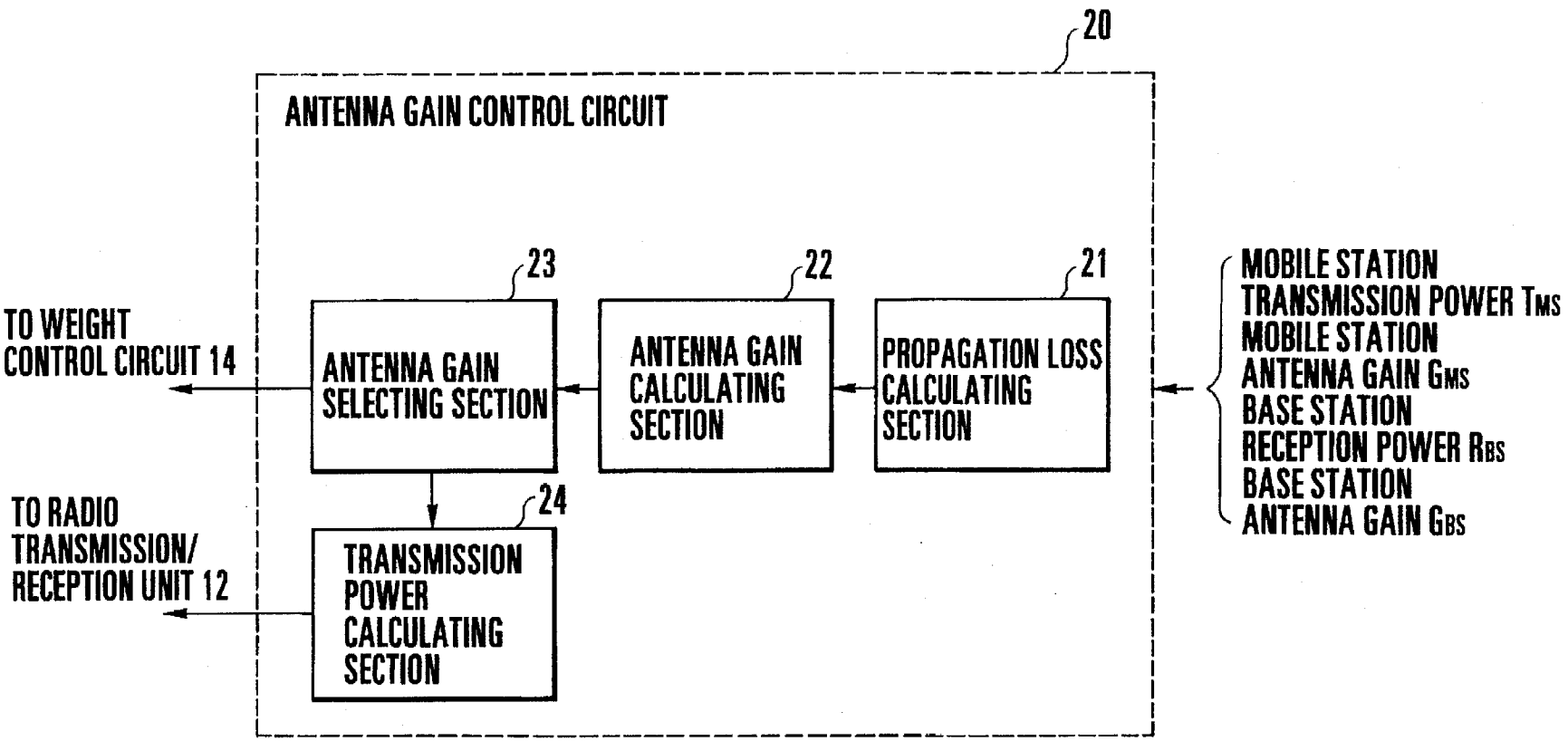
FIG. 2 is a block diagram showing an antenna gain control circuit in FIG. 1.

FIG. 2 shows an example of the antenna gain control circuit 20 in FIG. 1. Reference numeral 21 denotes a propagation loss calculating section for calculating the propagation loss in the reverse link from the mobile station 40 to the base station 1 on the basis of the mobile station transmission power, the mobile station antenna gain, the base station reception power, and the base station antenna gain which are obtained from the second radio transmission/reception unit 13 or the first radio transmission/reception unit 12.

Reference numeral 22 denotes an antenna gain calculating section for calculating the minimum antenna gain value which sets the speech quality of a reception signal received by the base station 1 to a predetermined value; 23, an antenna gain selecting section for selecting a predetermined antenna gain equal to or higher than the minimum antenna gain value output from the antenna gain calculating section 22; and 24, a transmission power calculating section for calculating proper base station transmission power which sets the reception communication quality in the mobile station 40 to a predetermined value under the condition of the calculated propagation loss.

Figure 3:
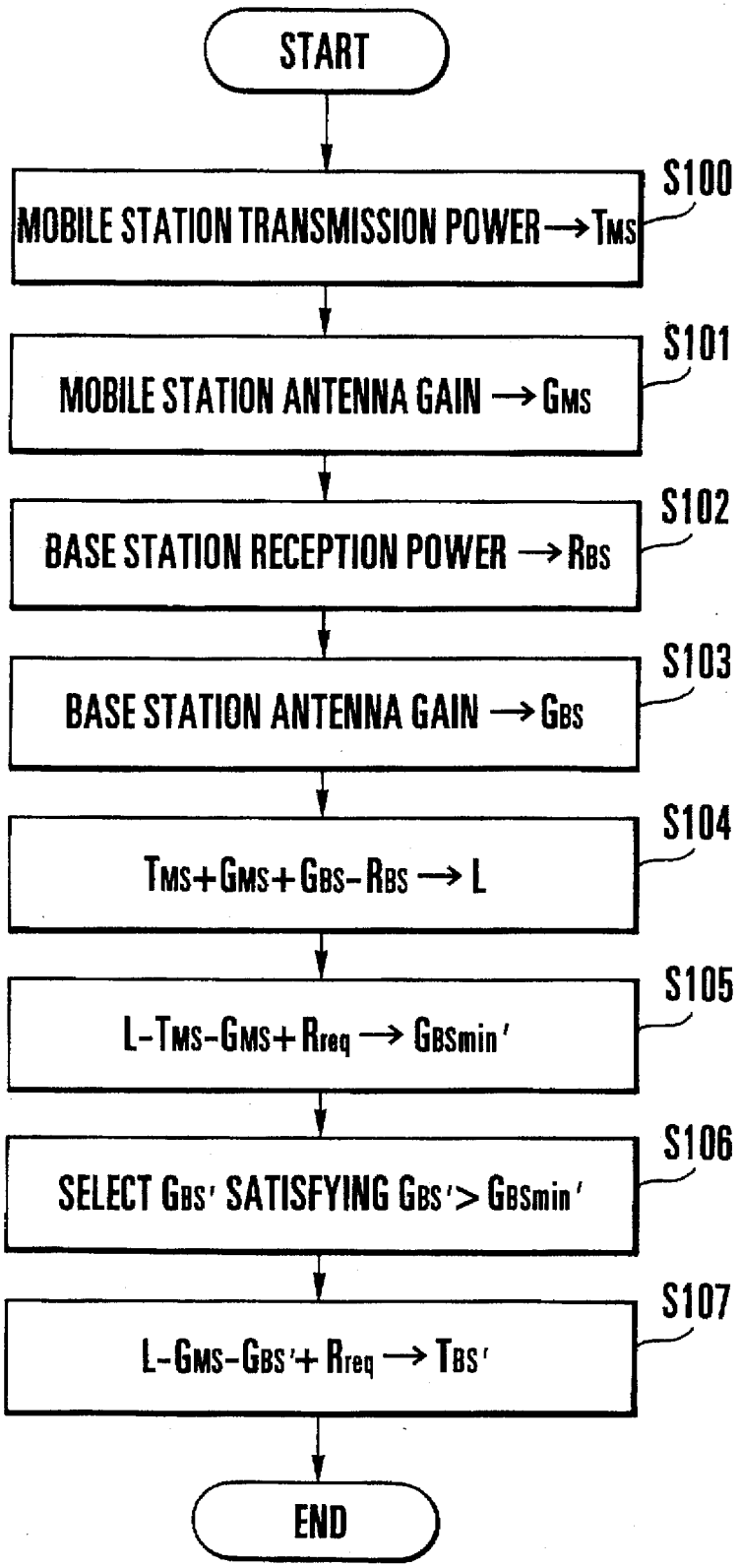
FIG. 3 is a flow chart showing the operation of the antenna gain control circuit in FIG. 2.

FIG. 3 shows the operation of the antenna gain control circuit 20 in FIG. 2. The operation of the radio communication system shown in FIG. 1 will be described with reference to FIGS. 2 and 3. In a state of not communicating with the mobile station 40, the antenna directivity control circuit 30 instructs the second weight control circuit 15 about the beam direction for a control channel. The second weight control circuit 15 calculates weighting coefficients for rotating the directivity pattern in accordance with the instruction from the antenna directivity control circuit 30, and outputs the weighting coefficients to the weighting circuit 11. The weighting circuit 11 weights the antenna elements 10*a* in accordance with the weighting coefficients from the second weight control circuit 15. With this operation, the directivity pattern of the antenna 10 electrically rotates. Upon rotation of the directivity pattern of the antenna 10, the second radio transmission/reception unit 13 performs transmission/reception between a plurality of mobile stations including the mobile station 40 through the control channel.

At the start of communication with the mobile station 40, mobile station transmission power $T_{MS}$, a mobile station antenna gain $G_{MS}$, base station reception power $R_{BS}$, and a base station antenna gain $G_{BS}$ are input from the second radio transmission/reception unit 13 to the propagation loss calculating section 21 of the antenna gain control circuit 20 (steps S100 to S103).

If the mobile station transmission power $T_{MS}$ and the mobile station antenna gain $G_{MS}$ are fixed, these values need not be input by storing them in the antenna gain control circuit 20 in advance. Assume that the mobile station transmission power $T_{MS}$ and the mobile station antenna gain $G_{MS}$ are variable. In this case, in a non-communication state, the mobile station 40 adds these values to an originating request signal or a page response signal to notify the second radio transmission/reception unit 13 of the values, and the values notified by the mobile station 40 are input to the propagation loss calculating section 21 through the second radio transmission/reception unit 13. In a communication state, the mobile station 40 adds these values to an in-communication control signal to input them to the propagation loss calculating section 21 through the first radio transmission/reception unit 12.

Since the base station reception power $R_{BS}$ and the base station antenna gain $G_{BS}$ are the intra-station information of the base station 1, these values are directly obtained by the second radio transmission/reception unit 13 and input to the propagation loss calculating section 21 of the antenna gain control circuit 20. During communication, these values are obtained by the first radio transmission/reception unit 12, as needed, and input to the propagation loss calculating section 21.

On the basis of the values input in this manner, the propagation loss calculating section 21 obtains a propagation loss L in the reverse link from the mobile station 40 to the base station 1 according to equation (1) (step S104):

$$L=T_{MS}+G_{MS}+G_{BS}-R_{BS} \quad (1)$$

The antenna gain calculating section 22 uses equation (2) to calculate a minimum antenna value $G_{BSmin'}$, which allows detection of a reception level $R_{req}$ at which a predetermined speech quality can be obtained in the base station 1 under the condition of the propagation loss L (step S105).

$$GBSmin'=L-TMS-GMS+R_{req} \quad (2)$$

On the basis of this value, the antenna gain selecting section 23 selects a proper value as an antenna gain $G_{BS}$, larger than the minimum antenna gain value $G_{BSmin'}$ to set the reception speech quality in the base station 1 to be higher than the predetermined value (step S106). The antenna gain selecting section 23 then notifies the first weight control circuit 14 of this value, and outputs it to the transmission power calculating section 24.

In this case, as the antenna gain increases, the transmission power reducing effects in the base station 1 and the mobile station 40 improve. However, since the beam width decreases, a tracking failure tends to occur in the mobile station 40. An antenna gain must be set in consideration of this point.

The transmission power calculating section 24 uses equation (3) to calculate transmission power $T_{BS}$, which allows detection of a reception level $R_{req}$ at which a predetermined speech quality can be obtained in the mobile station 40 under the current condition of the propagation loss L (step S107).

$$T_{BS}=L-G_{MS}-G_{BS}+R_{req} \quad (3)$$

The transmission power calculating section 24 then notifies the first radio transmission/reception unit 12 of this value.

In this manner, the antenna gain control circuit 20 determines the antenna gain $G_{BS}$ and the transmission power $T_{BS}$ on the basis of the mobile station transmission power $T_{MS}$, the mobile station antenna gain $G_{MS}$, the base station reception power $R_{BS}$, and the base station antenna gain $G_{BS}$. A transmission signal of the optimal level is output from the first radio transmission/reception unit 12 on the basis of this transmission power $T_{BS}$.

On the basis of the antenna gain $G_{BS}$ notified by the antenna gain control circuit 20, the first weight control circuit 14 calculates the optimal weighting coefficients output from the mobile station 40 to maximize the CIR, and outputs the weighting coefficients to the weighting circuit 11. The weighting circuit 11 weights the antenna elements 10*a* in accordance with the weighting coefficients from the first weight control circuit 14, and sets the directivity pattern of the antenna 10 for a communication channel. With this operation, the optimal reception level can be obtained by the second radio transmission/reception unit.

As described above, this system has the communication channel antenna gain control circuit 20 to use a control channel at the start of communication, and a communication channel during communication, and calculates the propagation loss in the reverse link from the base station 1 to the mobile station 40, thereby determining the antenna gain which allows a predetermined speech quality under the condition of the propagation loss.

Since the antenna directivity is controlled to obtain this antenna gain, or an antenna having this antenna gain is selected, the time required for antenna selection can be greatly shortened as compared with the conventional method of selecting an antenna to be used by actually performing communication using a non-directional or direction antenna. In addition, since the CIR increases, the interference reception level decreases to allow effective use of frequencies.

Figure 4:
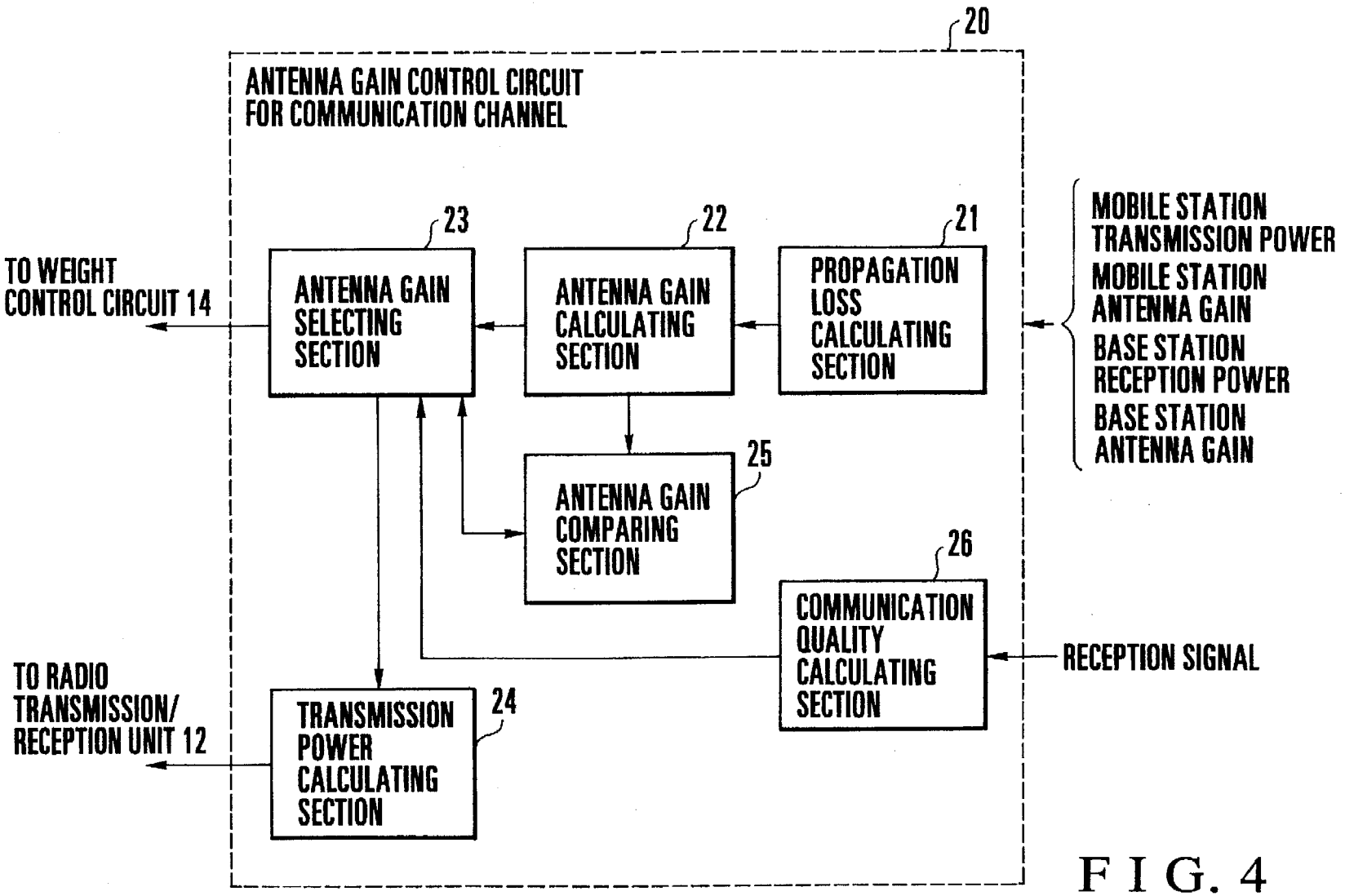
FIG. 4 is a block diagram showing another example of the antenna gain control circuit in FIG. 1.

FIG. 4 shows another example of the antenna gain control circuit in FIG. 1. The same reference numerals in FIG. 4 denote the same parts as in FIG. 2, and a description thereof will be omitted.

Referring to FIG. 4, reference numeral 25 denotes an antenna gain comparing section for storing an antenna gain $G_{BS}$ selected by an antenna gain selecting section 23, and comparing the antenna gain $G_{BS}$ with a minimum antennal gain value $G_{BSmin'}$ calculated by an antenna gain calculating section 22 under the current control; and 26, a communication quality calculating section for measuring/calculating communication qualities such as the CIR, BER (Bit Error Rate), and FER (Frame Error Rate) of a reception signal, and outputting them to the antenna gain selecting section 23.

Figure 5:
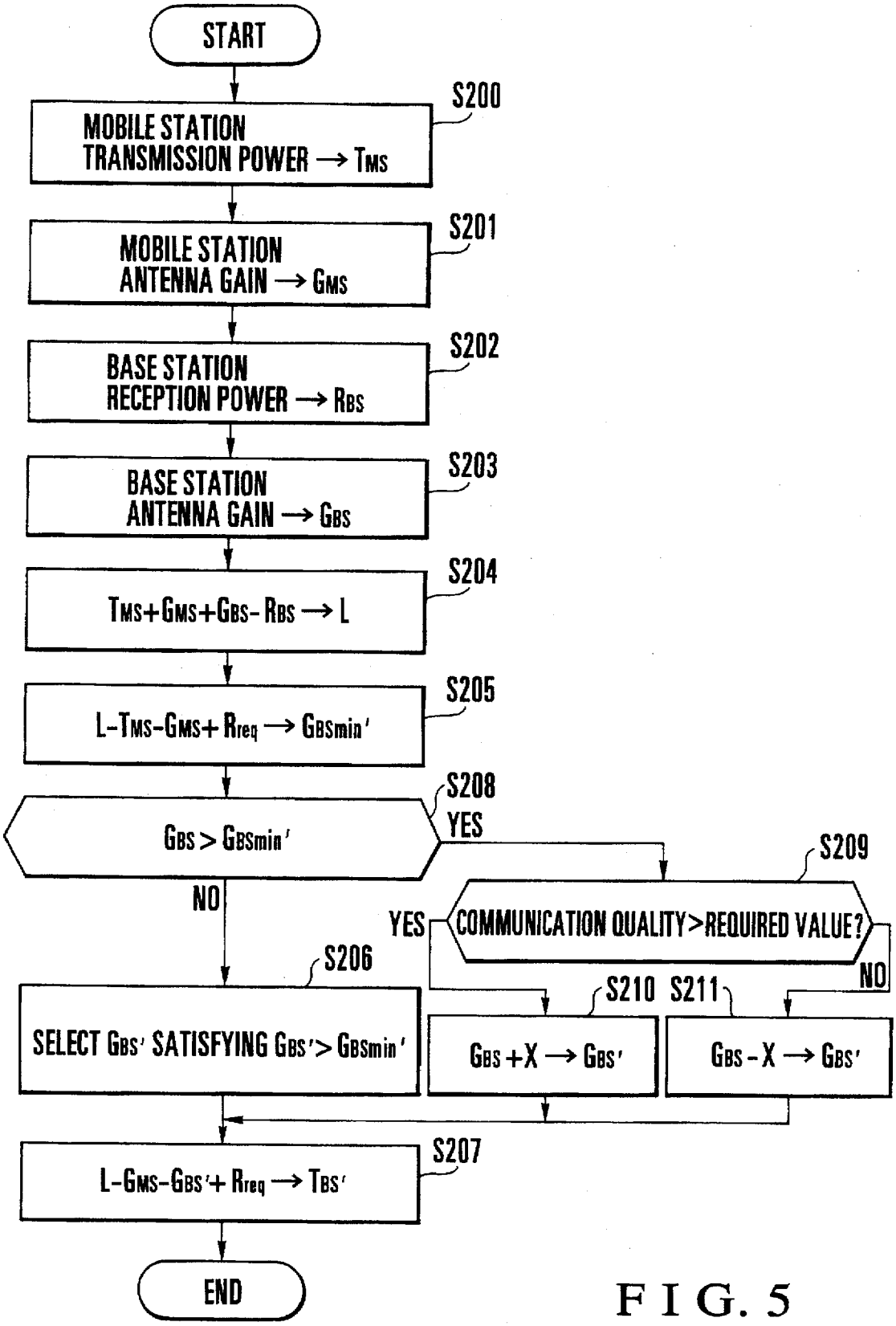
FIG. 5 is a flow chart showing the operation of the antenna gain control circuit in FIG. 4.

FIG. 5 shows the operation of the antenna gain control circuit 20 in FIG. 4. The operation of the radio communication system shown in FIG. 1 will be described with reference to FIGS. 4 and 5.

Similar to the above case, the mobile station transmission power $T_{MS}$, the mobile station antenna gain $G_{MS}$, the base station reception power $R_{BS}$, and the base station antenna gain $G_{BS}$ are input from the second radio transmission/reception unit 13 or the first radio transmission/reception unit 12 to the propagation loss calculating section 21 (steps S200 to S203).

The propagation loss calculating section 21 calculates the propagation loss L in the reverse link from the mobile station 40 to the base station 1 (step S204). The antenna gain calculating section 22 calculates the minimum antenna gain value $G_{BSmin'}$ on the basis of the calculated propagation loss (step S205). At this time, the antenna gain comparing section 25 compares the antenna gain $G_{BS}$, selected by the antenna gain selecting section 23 under the immediately preceding control, with the minimum antenna gain value GBSmin' calculated by the antenna gain calculating section 22 under the current control (step S208), and notifies the antenna gain selecting section 23 of the result.

The antenna gain selecting section 23 updates the antenna gain $G_{BS}$ to a proper value equal to or larger than the value $G_{BSmin'}$ if the comparison result notified by the antenna gain comparing section 25 indicates $G_{BS} \leqq G_{BSmin'}$ (step S206). If the comparison result notified by the antenna gain comparing section 25 indicates $G_{BS} > G_{BSmin'}$ the speech quality is checked.

The communication quality calculating section 26 measures a communication quality such as a CIR, a BER, or an FER on the basis of a reception signal from the first radio transmission/reception unit 12 or the second radio transmission/reception unit 13, and notifies the antenna gain selecting section 23 of the measurement result. The antenna gain selecting section 23 compares the speech quality notified by the communication quality calculating section 26 with a predetermined value (step S209).

If it is determined in step S209 that the currently measured speech quality exceeds the predetermined value, the immediately preceding antenna gain $G_{BS}$ is increased by a predetermined value x, and the resultant gain is set as the current antenna gain $GB_{BS'}$ (step S210). If it is determined that the currently measured speech quality is equal to or lower than the predetermined value, the immediately preceding antenna gain $G_{BS}$ is decreased by the predetermined value x, and the resultant gain is set as the current antenna gain $G_{BS'}$ (step S211).

That is, the antenna gain selecting section 23 selects the antenna gain $G_{BS'}$ used for the current control in steps S206, S210, and S211, notifies the first weight control circuit 14 of the gain, and outputs it to the transmission power calculating section 24. The transmission power calculating section 24 calculates the transmission power $T_{BS'}$ which allows detection of the reception level $R_{req}$ at which a predetermined speech quality can be obtained in the mobile station 40 under the current condition of the propagation loss L (step S207), and notifies the first radio transmission/reception unit 12 of this value.

As described above, the antenna gain $G_{BS}$ selected under the immediately preceding control is compared with the current minimum antenna gain value $G_{BSmin'}$. If the value $G_{BSmin'}$ is lower than the gain $G_{BS'}$ and the currently measured speech quality exceeds the predetermined value, the gain obtained by increasing the immediately preceding antenna gain $G_{BS}$ by the predetermined value x is set as the current antenna gain $G_{BS'}$. As long as communication with the distant station can be performed, the antenna directivity is controlled such that the antenna has a high gain with a small beam width, or an antenna having this antenna directivity is selected, thereby suppressing the transmission power to the minimum necessary value.

Assume that the antenna gain $G_{BS}$ selected under the immediately preceding control is compared with the minimum antenna gain value $G_{BSmin'}$ calculated under the current control, and it is determined that the value $G_{BSmin'}$ is lower the gain $G_{BS'}$ and the currently measured speech quality is equal to or lower than the predetermined value. In this case, the gain obtained by decreasing the immediately preceding antenna gain $G_{BS}$ by the predetermined value x is set as the current gain $G_{BS'}$. With this operation, when communication is disabled, the antenna directivity is controlled such that antenna has a large beam width, or an antenna having this antenna directivity is selected, thereby tracking the distant station in a wider range.

As has been described above, according to the present invention, the time required for antenna selection can be greatly shortened, and the CIR increases. For this reason, the interference reception level decreases to allow more effective use of frequencies, thus realizing efficient radio communication.

In addition, since the current antenna gain is determined by using the preceding antenna gain, the antenna directivity is controlled such that the antenna has a high gain with a small beam width, or an antenna having this directivity is selected. With this operation, the transmission power can be suppressed to the minimum necessary value.

Furthermore, even if the self-station fails to track the distant station, the antenna directivity is controlled such that the antenna has a large beam width, or an antenna having this directivity is selected, the self-station can track the distant station in a wider range.

What is claimed is:

1. A mobile communication system comprising:

an antenna having a variable directivity pattern;

a first transmission/reception unit for transmitting/receiving communication information to/from a distant station through a communication channel by using said antenna;

propagation loss calculating means for calculating a propagation loss in a radio channel including a communication channel between said antenna and the distant station;

antenna gain calculating means for calculating a minimum antenna gain value required for communication under the condition of the propagation loss calculated by said propagation loss calculating means;

antenna gain selecting means for selecting an antenna gain not less than the minimum antenna gain value calculated by said antenna gain calculating means; and first directivity pattern control means for controlling the directivity pattern of said antenna in a communication state on the basis of the antenna gain selected by said antenna gain selecting means.

2. A system according to claim 1, wherein said propagation loss calculating means calculates the propagation loss on the basis of distant station transmission power, a distant station antenna gain, self-station reception power, and a self-station antenna gain.

3. A system according to claim 2, wherein said propagation loss calculating means calculates the propagation loss by using information of distant station transmission power and a distant station antenna gain which are transmitted from the distant station.

4. A system according to claim 2, wherein said propagation loss calculating means calculates the propagation loss by using information of distant station transmission power and a distant station antenna gain which are set in the self-station in advance.

5. A system according to claim 2, further comprising a second transmission/reception unit for transmitting/receiving a control signal to/from the distant station by using said antenna, and wherein said propagation loss calculating means calculates the propagation loss by using the self-station reception power and the self-station antenna gain which are obtained from said second transmission/reception unit in a non-communication state, and calculates the propagation loss by using the self-station reception power and the self-station antenna gain which are obtained from said first transmission/reception unit in a communication state.

6. A system according to claim 1, wherein said antenna comprises a plurality of antenna elements and weighting means for electrically rotating the directivity pattern by weighting said antenna elements in accordance with weighting coefficients, and said first directivity pattern control means comprises weighting control means for calculating optimal weighting coefficients for maximizing a carrier to interference ratio of a signal transmitted from the distant station on the basis of the antenna gain selected by said antenna gain selecting means, and outputting the weighting coefficients to said weighting means.

7. A system according to claim 6, further comprising transmission power calculating means for calculating transmission power for obtaining a reception level, at which a predetermined communication quality is ensured in the distant station under the condition of the propagation loss calculated by said propagation loss calculating means, on the basis of the antenna gain calculated by said antenna gain calculating means, and wherein said first radio transmission/reception means outputs a transmission signal having an optimal level in accordance with the transmission power notified by said transmission power calculating means.

8. A system according to claim 1, further comprising:

beam direction instructing means for instructing a beam direction of a control channel in a non-speech communication state;

second directivity pattern control means for controlling the directivity pattern of said antenna in a control channel in accordance with an instruction from said beam direction instructing means; and a second transmission/reception unit for transmitting/receiving a control signal to/from the distant station through a control channel by using said antenna whose directivity pattern is controlled by said second directivity pattern control means.

9. A system according to claim 1, further comprising:

antenna gain comparing means for comparing a minimum antenna gain value newly calculated by said antenna gain calculating means with an antenna gain selected under immediately preceding control; and communication quality calculating means for calculating a communication quality associated with a reception signal received from the distant station, and wherein said antenna gain selecting means outputs a new antenna gain obtained by increasing the antenna gain selected under the immediately preceding control by a predetermined value when it is determined on the basis of the comparison result obtained by said antenna gain comparing means that the antenna gain selected under the immediately preceding control is not less than the newly calculated minimum antenna gain value, and the communication quality calculated by said communication quality calculating means is not less than a predetermined value.

10. A system according to claim 9, wherein said antenna gain selecting means outputs a new antenna gain obtained by decreasing the antenna gain selected under the immediately preceding control by a predetermined value when it is determined on the basis of the comparison result obtained by said antenna gain comparing means that the antenna gain selected under the immediately preceding control is not less than the newly calculated minimum antenna gain value, and the communication quality calculated by said communication quality calculating means is less than a predetermined value.

11. A system according to claim 1, further comprising:

a plurality of base stations respectively installed in a plurality of radio zones, each base station including said antenna, a first transmission/reception unit, propagation loss calculating means, antenna gain calculating means, antenna gain selecting means, and first directivity pattern control means; and a mobile station as a distant station which performs radio communication with said base station.

* * * * *